US005538051A

United States Patent [19]

Brown et al.

[11] Patent Number: 5,538,051

[45] **Date of Patent: *Jul. 23, 1996**

[54] CNG REFUELING SYSTEM FOR MULTIPLE VEHICLES

[75] Inventors: Jack E. Brown; David A. Diggins, both of Midland, Tex.

[73] Assignee: Pinnacle CNG Systems, LLC, Midland, Tex.

[ * ] Notice: The term of this patent shall not extend beyond the expiration date of Pat. No. 5,351,726.

[21] Appl. No.: 317,903

[22] Filed: Oct. 4, 1994

Related U.S. Application Data

[63] Continuation-in-part of Ser. No. 127,426, Sep. 27, 1993, Pat. No. 5,351,726.

[51] Int. Cl.[6] ..... B65B 31/00; B67C 3/00

[52] U.S. Cl. ..... 141/18.000; 141/83; 141/197; 62/7; 123/525; 123/527; 137/110; 137/599

[58] Field of Search ..... 141/2, 4, 18, 21, 141/83, 95, 197, 37, 39, 59, 234, 237, 242, 243; 62/7, 50.1, 50.2, 50.3; 123/525, 527; 137/110, 599

[56] References Cited

U.S. PATENT DOCUMENTS

| | | | |
|---|---|---|---|
| 4,153,083 | 5/1979 | Imler et al. | 141/237 |
| 4,260,000 | 4/1981 | McGahey et al. | 141/59 |
| 4,501,253 | 2/1985 | Gerstmann et al. | 123/527 |
| 4,515,516 | 5/1985 | Perrine et al. | 417/38 |
| 4,522,159 | 6/1985 | Engel et al. | 123/1 A |
| 4,527,600 | 7/1985 | Fisher et al. | 141/4 |
| 4,531,558 | 7/1985 | Engel et al. | 141/4 A |
| 4,646,940 | 3/1987 | Kramer et al. | 222/1 |
| 4,749,384 | 6/1988 | Nowobilski et al. | 55/27 |
| 4,966,206 | 10/1990 | Baumann et al. | 141/83 |
| 5,029,622 | 7/1991 | Mutter | 141/4 |
| 5,169,295 | 12/1992 | Stogner et al. | 417/339 |
| 5,351,726 | 10/1994 | Diggins | 141/197 |

*Primary Examiner*—Henry J. Recla
*Assistant Examiner*—Steven O. Douglas
*Attorney, Agent, or Firm*—Ross, Clapp, Korn & Montgomery

[57] ABSTRACT

A system and method for selectively refueling a plurality of vehicle storage tanks with compressed natural gas (CNG) are provided that utilize a compressor system operable at suction pressures ranging from about 330 to about 3600 psig and discharge pressures ranging from about 330 to about 4500 psig in combination with a tank for temporarily storing CNG at an intermediate storage pressure of from about 330 to about 4500 psig, preferably from about 1700 to about 2700 psig, apparatus for selectively filling vehicle storage tanks with CNG from an inlet source, from the compressor discharge and from the intermediate storage tanks, and apparatus for selectively supplying CNG to the compressor inlet at either the available line pressure or the intermediate storage pressure.

16 Claims, 2 Drawing Sheets

CNG REFUELING SYSTEM FOR MULTIPLE VEHICLES

CROSS-REFERENCE TO ELATED APPLICATION

This application is a continuation-in-part of U.S. application Ser. No. 127,426, filed Sep. 27, 1993, and issued Oct. 4, 1994, as U.S. Pat. No. 5,351,726.

BACKGROUND OF THE INVENTION

1. Field of the Invention

This invention relates to natural gas refueling systems, and more particularly, to a system and method for compressing natural gas and for refueling a plurality of motor vehicles through the use of individual dispensing hoses with valves controllable by a computer so as to maximize the refueling rate of each vehicle's fuel tank independently of any other vehicle.

2. Description of Related Art

The use of compressed natural gas ("CNG") as an alternative fuel for motor vehicles is well known. Natural gas is in most cases a less costly and cleaner-burning fuel than gasoline. One disadvantage of natural gas as a motor vehicle fuel is the volume required to store the quantity of gas needed to provide a range of travel comparable to that experienced with gasoline. In order to store a sufficient volume of natural gas to provide a reasonable range of travel, it has been thought desirable to compress the natural gas to a pressure of about 3000 to 3600 psi or higher.

Because the vehicle tank pressures needed to store sufficient natural gas to provide a reasonable range of travel are relatively high when compared to available consumer line pressures, the refueling of vehicle storage tanks presents yet another problem. Refilling vehicle storage tanks with CNG within a time period comparable to that required to refill conventional vehicle fuel tanks with gasoline can necessitate the use of large, expensive, multistage compressors. Alternatively, home or on-board CNG refueling systems have been developed that can deliver the compressed gas at the required pressure, but such systems are characterized by very low flow rates, necessitating long periods (such as overnight) for refueling.

Among the various systems for refueling vehicle storage tanks that have previously been disclosed, one conventional system uses a large, multistage compressor to compress the natural gas to about 4000 psi or greater and then holds the CNG in large volume intermediate storage tanks at that pressure. During refueling, the CNG is allowed to flow into the vehicle storage tanks until the vehicle tank pressure is about 3000 psi. After refueling, the intermediate storage is replenished with sufficient gas to again raise the storage pressure to about 4000 psi. This system is inefficient because of the repetitive need to charge storage tanks to about 4000 psi.

Another system, disclosed in U.S. Pat. No. 4,646,940, utilizes a differential pressure measuring apparatus in controlling CNG refueling. The patent discloses preferentially refueling the CNG tanks of a vehicle first from low pressure, then intermediate pressure, and finally, high pressure storage tanks. A reference cylinder at 2750 psi is used to cut off the refueling operation.

U.S. Pat. No. 4,501,253 discloses a low volume (approximately one cubic foot per minute) on-board automotive methane compressor for refilling vehicle storage tanks by compressing the gas from available line pressure to about 2000 to 3000 psi.

U.S. Pat. No. 4,515,516 and 5,169,295 disclose systems in which liquid pressure is used to boost CNG pressures in a storage/refueling process. U.S. Pat. No. 4,515,516 discloses a home use natural gas refueling system in which a liquid is used to boost the gas from line pressure to greater than 2000 psi. The system utilizes a variable rate pump which pumps the compression fluid at a high rate for low pressures and a low rate for high pressures. (An illustrative flow rate is about one gallon per minute of compression fluid above 600 psi.)

U.S. Pat. No. 5,169,295 discloses a higher volume liquid-based compression system that can be mounted on a car, truck, boat, train or plane, but is preferably mounted on a tractor trailer truck with the hydraulic pumps connected to the tractor engine by a transfer case. The maximum pressure of the liquid supplied from the liquid supply means is less than the minimum pressure of the gas from the gas-supplying conduit. In the preferred embodiment the supply pump has an maximum output pressure of about 350 psig, and the maximum pressure of the gas-supplying conduit may range from about 400 to about 2900 psig. Illustrative pumping rates for the compression liquid range up to about 200 gpm.

Other previously disclosed CNG refueling systems utilize adsorbent-filled cylinders to reduce the tank pressure needed to store a predetermined amount of natural gas. Such systems are disclosed, for example, in U.S. Pat. No. 4,522,159; 4,53 1,558; and 4,749,384.

SUMMARY OF THE INVENTION

According to the present invention, a CNG refueling system and method are provided that will enable motor vehicle storage tanks to be refueled quickly and efficiently through the use of a compressor system that is operable over a wide range of suction pressures in combination with means for temporarily storing the CNG at a preferred intermediate storage pressure of from about 1700 to about 2700 psig, and most preferably from about 2300 to about 2400 psig (based on a storage temperature of about 70° F.) and means for selectively supplying gas to the compressor system at the intermediate storage pressure. Because the most efficient storage pressure for natural gas at 70° F. ranges from about 1700 to about 2700 psig, within this pressure range the greatest volume of gas can be withdrawn from storage with the smallest attendant reduction in storage vessel pressure. By selectively controlling the inlet gas supply to the compressor system between an external (relatively low pressure) supply line and intermediate storage vessels, thereby taking advantage of the higher density of gas drawn from the intermediate storage vessels, one can achieve an increase in compressor capacity without increasing horsepower or energy consumption. Where the desired maximum vehicle tank pressure exceeds about 3000 psig, refueling rates can be increased and horsepower requirements reduced by first delivering CNG to the vehicle storage tanks simultaneously from the compressor and from the intermediate storage tanks until the vehicle tank pressure equalizes with the intermediate storage pressure, and then by "topping off" the tanks with CNG supplied to the compressor from intermediate storage at pressures ranging between 1700 and 2700 psig. Whereas a 20 horsepower compressor may, for example, compress about 97 cfm natural gas from a suction pressure of about 800 psig to a discharge pressure of about 3000 psig, the same 20 horsepower compressor may compress about 345 cfm natural gas from a suction pressure of about 2500 psig to a discharge pressure of about 3000 psig. This increased CNG delivery rate at higher pressures enables a user to fill vehicle storage tanks quickly and efficiently to pressures greater than 3000 psig.

According to one embodiment of the invention, a CNG vehicle refueling system is provided that comprises: Means for selectively delivering natural gas received from an external source directly to a motor vehicle storage tank at the available line pressure; means for simultaneously delivering part of the natural gas received from the external source directly to the motor vehicle storage tank and for compressing part of the natural gas received from the external source and delivering the CNG to intermediate storage at a pressure higher than the available line pressure; means for simultaneously delivering CNG to the vehicle storage tank from the compressor discharge and from intermediate storage; means for selectively delivering CNG from the intermediate storage to the suction side of the compressor for further compression; means for delivering the further-compressed natural gas into the motor vehicle storage tank; and means for selectively refilling the intermediate storage with natural gas compressed from available line pressure after the vehicle storage tank is filled.

According to another preferred embodiment of the invention, the subject refueling system comprises a single stage compressor operable over a range of suction pressures extending, for example, from about 330 to about 3600 psig with a discharge pressure of up to about 4500 psig, in combination with means for temporarily storing the compressed gas in intermediate storage at a pressure ranging between about 330 and about 3600 psig (preferably between about 1700 and about 2700 psig, and most preferably between about 2300 and about 2400 psig), and means for selectively controlling the supply of gas to the suction side of the compressor from either a relatively low pressure source such as a natural gas transmission line or from the intermediate storage.

According to another embodiment of the invention, a motor vehicle refueling system is provided that comprises in combination: A single stage compressor connectable to a source supplying natural gas at a pressure ranging from about 330 to about 1000 psig that is operable at suction pressures ranging from about 330 to about 3600 psig and at discharge pressures ranging from about 330 to about 4500 psig; intermediate storage means for temporarily storing CNG at intermediate storage pressures ranging from about 330 to about 3600 psig, preferably from about 1700 to about 2700 psig, and most preferably from about 2300 to about 2400 psig; means for supplying natural gas received from the external source directly to a motor vehicle storage means at a supply pressure ranging from about 330 to about 1000 psig; means for simultaneously supplying CNG to the vehicle storage means from the intermediate storage means and from the compressor until the pressure in the vehicle storage means equalizes with the intermediate storage pressure; means for further compressing CNG supplied from the intermediate storage means up to the maximum intended fill pressure for the vehicle storage means, preferably from about 3000 to as high as about 4500 psig, to complete filling the vehicle storage means; and means for compressing natural gas from the source pressure up to the desired intermediate storage pressure to refill the intermediate storage means after the refueling the vehicle storage means.

According to another embodiment of the invention, a method for refilling vehicle storage tanks with CNG is provided that comprises the step of using CNG supplied from intermediate storage at a pressure ranging from about 330 to about 3600 psig, preferably from about 1700 to about 2700 psig, and most preferably from about 2300 to about 2400 psig, as the feed to a compressor that is capable of further pressurizing the CNG to a discharge pressure as high as the intended maximum fill pressure of the vehicle storage tanks, ranging up to about 4500 psig, and most preferably from about 3000 to about 3600 psig. By using CNG temporarily stored at a pressure ranging from about 1700 to about 2700 psig to supply a refueling compressor, one can "top off" vehicle storage tanks quickly and more efficiently than has been achieved through the use of prior art methods.

According to another embodiment of the invention, a method for refueling vehicle storage tanks with CNG is provided that comprises the steps of: Supplying natural gas at a pressure ranging from about 330 to about 1000 psig to a single stage compressor that is operable at suction pressures ranging from about 330 to about 3600 psig with attendant discharge pressures ranging from about 330 to about 4500 psig; compressing and temporarily storing CNG at intermediate storage pressures ranging from about 330 to about 3600 psig, preferably from about 1700 to about 2700 psig, and most preferably from about 2300 to about 2400 psig; compressing CNG from the supply pressure (about 330 to about 1000 psig) to the vehicle storage tank pressure and discharging the CNG to the vehicle storage tanks while simultaneously supplying CNG to the vehicle storage tanks from the intermediate storage tanks and while allowing the vehicle storage tank pressure to equalize with the intermediate storage tank pressure; when the vehicle storage tank pressure has equalized with the intermediate storage tank pressure, supplying CNG to the compressor from the intermediate storage tanks and further compressing the CNG up to the intended full vehicle storage tank pressure, preferably from about 3000 to about 4500 psig, and most preferably from about 3000 to about 3600 psig, until the vehicle storage tanks are filled; and thereafter refilling the intermediate storage tanks with CNG supplied to the compressor at about 330 to about 1000 psig until such time as the intermediate storage tanks are again filled to a predetermined pressure ranging from about 330 to about 3600 psig, preferably from about 1700 to about 2700 psig, and most preferably from about 2300 to about 2400 psig.

According to one preferred embodiment of the method of the invention, when the vehicle storage tank pressure is below the available line pressure (preferably from about 330 to about 1000 psig) at which natural gas is supplied to the compressor suction at the start of refueling, the vehicle storage tank pressure is allowed to equalize with the available line pressure prior to supplying CNG to the vehicle storage tanks either from the compressor or from the intermediate storage tanks. While in this mode of operation, if the pressure in the intermediate storage tanks is below a predetermined desirable level such as, for example, preferably from about 1700 to about 2700 psig, and most preferably from about 2300 to about 2400 psig, the compressor can be used to refill the intermediate storage tanks to the predetermined desirable pressure level while the vehicle storage tank pressure is equalizing with the available line pressure. As used herein, the term "available line pressure" is used to include any source (other than the storage tanks of the vehicle being refueled) of natural gas at a pressure ranging from about 330 to about 1000 psig. Where the actual available line pressure is lower than about 330 psig, the use of a booster pump or other similarly satisfactory means may be required in order to raise the line pressure to a level of at least about 330 psig.

According to another preferred embodiment of the invention, a CNG refueling system for a plurality of motor vehicles each having CNG storage means is provided, the system comprising compressor means operable over suction pressures ranging from about 330 to about 3600 psig and discharge pressures ranging from about 330 psig to about 4500 psig; at least one intermediate storage tank for storing CNG at pressures ranging from about 330 to about 3600 psig; means for selectively delivering natural gas received from an external source to the compressor means; means for selectively delivering CNG discharged from the compressor means into the intermediate storage tank until the pressure in the intermediate storage tank reaches a predetermined maximum level not greater than about 3600 psig; means for selectively controlling the delivery of CNG to the CNG storage means of each vehicle; means for selectively delivering CNG to each selected vehicle CNG storage means from the intermediate storage tank or from the compressor means; and means for selectively supplying CNG to the compressor means from the intermediate storage tank until the pressure in each selected vehicle CNG storage means reaches a maximum intended vehicle storage fill pressure. According to a particularly preferred embodiment of the invention, means are provided in the foregoing system for selectively and simultaneously delivering CNG to each selected vehicle storage means from the intermediate storage tank and from the compressor means. According to yet another embodiment of the invention, means are provided in the foregoing system for selectively delivering natural gas received from the external source directly into the selected vehicle storage means until pressure in the selected vehicle storage means equalizes with the pressure of the external source.

According to another embodiment of the invention, a method is disclosed for selectively refilling a plurality of vehicle CNG storage means from an initial pressure to an intended fill pressure with compressed natural gas, the method comprising the steps of providing a source of natural gas at a supply pressure ranging from about 330 to about 1000 psig; providing an intermediate storage tank; selectively delivering natural gas from the source to a compressor means that is operable at suction pressures ranging from about 330 to about 3600 psig with attendant discharge pressures ranging up to about 4500 psig; compressing the natural gas and selectively storing the compressed natural gas discharged from the compressor means in the intermediate storage tank until an intermediate storage pressure ranging up to about 3600 psig is reached; selectively delivering compressed natural gas to each selected vehicle CNG storage means from the intermediate storage tank or from the compressor means until the vehicle CNG storage means pressure equalizes with the intermediate storage tank pressure; selectively delivering compressed natural gas to the compressor from the intermediate storage tank and further compressing the natural gas; and selectively delivering the further compressed natural gas from the compressor to the selected vehicle CNG storage means until the selected vehicle CNG storage pressure reaches the intended fill pressure. According to another preferred embodiment of the invention, compressed natural gas is simultaneously delivered to each selected vehicle CNG storage means from both the intermediate storage tank and from the compressor means until the vehicle CNG storage means pressure equalizes with the intermediate storage tank pressure. According to another preferred embodiment of the invention, natural gas is selectively delivered from the source to the vehicle CNG storage means until the vehicle CNG storage means pressure equalizes with the supply pressure.

BRIEF DESCRIPTION OF THE DRAWINGS

The apparatus of the invention is further described and explained in relation to the following figures of the drawings wherein.

DESCRIPTION OF THE PREFERRED EMBODIMENTS

Figure 1:
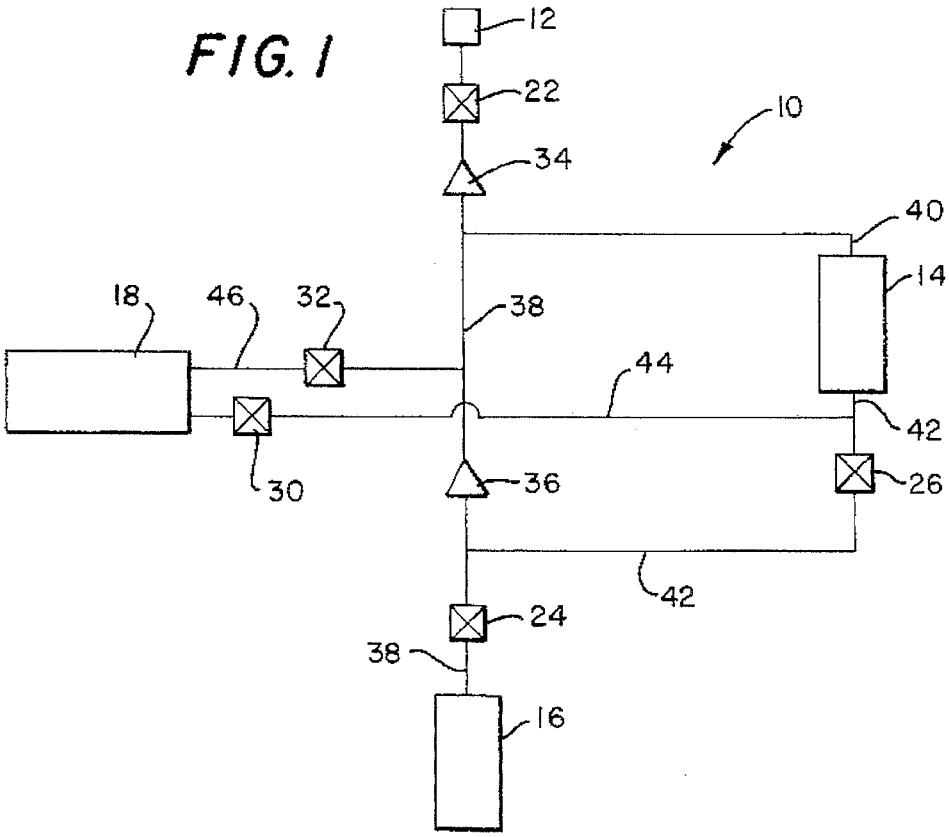
FIG. 1 is a simplified block flow diagram depicting the CNG refueling system of the invention.

Referring to FIG. 1, refueling system 10 of the invention preferably comprises inlet source 12; compressor 14; intermediate storage tank 18; valves 22, 24, 26, 30, 32; check valves 34, 36 and flow lines 38, 40, 42, 44, 46. Refueling system 10 is preferably intended for use in refueling vehicle storage tank 16 with compressed natural gas. Although intermediate storage tank 18 and vehicle storage tank 16 are shown in FIG. 1 as single tanks, it will be appreciated by those of ordinary skill in the art upon reading this disclosure that a plurality of interconnected tanks can be substituted for either within the scope of the invention.

Inlet source 12 preferably provides natural gas to refueling system 10 at a pressure ranging from about 330 up to about 1000 psig. As used herein, inlet source 12 can be a pipeline having an available line pressure of at least about 330 psig, or can be any other similarly effective source of gas at that pressure such as, for example, an auxiliary storage tank, a discharge line from a booster compressor, or the like. Means are preferably provided for selectively placing inlet source 12 in fluid communication with compressor 14 and/or with vehicle storage tank 16. Such means can include, for example, such flow lines, valves, gauges and meters as may be desirable to selectively control the flow of CNG between inlet source 12, compressor 14, vehicle storage tank 16, and intermediate storage tank 18 in accordance with the method of the invention. Although one preferred embodiment of the invention is disclosed in FIG. 1 and described in further detail below, it will be apparent to one of ordinary skill in the art upon reading this disclosure that other piping and valving arrangements can be similarly utilized without departing from the claimed invention. Where particular types of valves are shown, described, or otherwise referred to herein, it will likewise be understood that other types of valves can be similarly utilized within the scope of the invention. Thus, for example, electrically or pneumatically operated valves may be substituted for manually operated valves, manually operated valves may be substituted for check valves, and the like. Valves and other controllers not shown in FIG. 1 can also be added if desired to further control flow between individual vehicle storage tanks, intermediate storage tanks, or the like. Temperature and pressure gauges can be utilized as desired, and the entire system can be installed so as to be computer controlled or otherwise automated in response to measured temperatures, pressures, flow rates or the like throughout the system.

According to a preferred embodiment of the invention, FIG. 1 discloses one inlet source 12 that communicates through flow line 38 with vehicle storage tank 16. Because FIG. 1 is a simplified block flow diagram, the mechanical interconnection between flow line 38 and vehicle storage tank 16 is not shown. In an actual installation of refueling system 10, the mechanical interconnection between flow line 38 of the refueling system and the vehicle being refueled could be a threaded connection situated, for example, between valve 24 and vehicle storage tank 16, or any other similarly effective interconnecting means. Although only one vehicle storage tank 16 is shown in FIG. 1, more tanks can be similarly utilized, depending upon factors such as tank size, vehicle configuration, the desired range of travel, and the like.

Valve 22 preferably controls the flow of pressurized natural gas into refueling system 10 from inlet source 12. Check valves 34, 36 desirably control the direction of flow through line 38 toward vehicle storage tank 16 and prevent undesirable flow reversals that might otherwise occur due to unexpected pressure changes, leaks, equipment failures, or the like. Valve 24 controls the flow of pressurized natural gas into vehicle storage tank 16.

Compressor 14 is preferably located and connected in such manner that line 38 communicates with compressor inlet line 40 downstream of check valve 34 and upstream of check valve 36. Compressor 14 is desirably a single stage hydraulic compressor designed and constructed so as to operate at suction pressures ranging from about 330 up to about 3600 psig and at discharge pressures ranging from about 330 psig up to about 4500 psig. Such compressors are commercially available, for example, from Hydro Pac, Inc. of Fairview, Pa. Commercially available vehicle storage tanks are typically rated at either 3000 or 3600 psig. Under the NGV-2 Standard established by the Natural Gas Vehicle Coalition, such tanks can be overfilled by 25% of their rated pressure. A 3000 psig rated tank could therefore be filled to 3750 psig and a 3600 psig rated tank could be filled to 4500 psig. For this reason, 4500 psig is said to be the preferred upper limit for the discharge pressure of compressor 14 utilized in the system and method of the invention. Compressors such as compressor 14 utilized in the present invention will generally be capable of compressing gasses such as natural gas at a ratio of about 8:1, and ratios as high as about 10:1 may be achieved.

Figure 2:
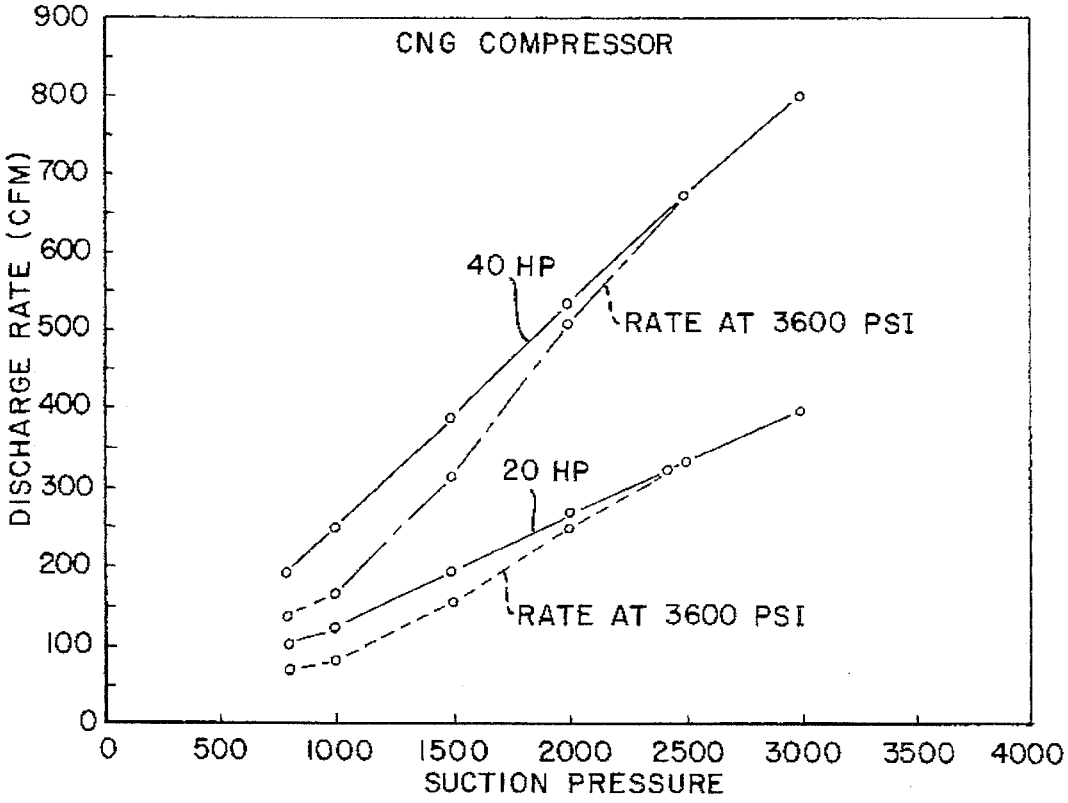
FIG. 2 is a graph showing compressor discharge rates plotted against suction pressures at a discharge pressure of 3600 psig for 20 and 40 horsepower compressors suitable for use in the system and method of the invention.

FIG. 2 is a graph plotting suction pressure versus discharge rate (in cubic feet per minute) for CNG compressors operating at 20 and 40 horsepower with a discharge pressure of 3600 psig. Because of the wide range of acceptable suction pressures for such a compressor, it can be selectively supplied with natural gas either from inlet source 12 at a pressure as low as about 330 psig, or for reasons described in greater detail below in accordance with the method of the invention, at intermediate storage pressures as high as about 3600 psig. Where CNG refueling system 10 of the invention is intended for use in a high volume application, such as, for example, in fleet refueling or in a commercial CNG refueling station, it is of course possible to connect two or more compressors 14 in parallel as required to provide a refueling capability during times when one of the compressors is shut down for maintenance or repair.

Compressor discharge line 42 preferably communicates with flow line 38 downstream of check valve 36, and with at least one intermediate storage tank 18 through line 44. Gas flow through line 42 is preferably controlled by valve 26, disposed downstream from the connection between line 42 and line 44. Flow through line 44 is preferably controlled by valve 30. Line 46 preferably connects intermediate storage tank 18 through valve 32 with flow line 38 and with compressor inlet line 40 between check valves 34 and 36.

The method of the invention is further described and explained in relation to the structural elements of refueling system 10 as described above. When refueling commences, vehicle storage tank 16 is first connected to flow line 38 downstream of valve 24. If the pressure in vehicle storage tank 16 is less than the available line pressure at inlet source 12 when refueling commences, valves 22, 24 are opened and gas is permitted to flow into tank 16 through flow line 38 until the pressure equalizes. If, during that time, the pressure in intermediate storage tank 18 is already at or above the preferred maximum intermediate storage pressure, valves 26, 30, 32 remain closed. If, on the other hand, the pressure in intermediate storage tank 18 is less than the preferred maximum intermediate storage pressure, compressor 14 is activated and valve 30 is opened, permitting CNG discharged from compressor 14 to flow into tank 18. If the pressure in storage tank 18 reaches the predetermined desired maximum level before the vehicle tank pressure equalizes with the inlet source pressure, compressor 14 will cease operation and valve 30 will desirably close.

Although intermediate storage tank pressures ranging from about 330 psig to about 3600 psig can be experienced utilizing the present invention, the preferred maximum intermediate storage pressure is about 2700 psig because the greatest storage efficiency is achieved at intermediate storage pressures ranging from about 1700 psig to about 2700 psig (assuming a temperature of about 70° F.), and most preferably, from about 2300 psig to about 2400 psig.

If the pressure in vehicle storage tank 16 equalizes with the inlet source pressure before the pressure in intermediate storage tank 18 reaches the predetermined maximum level, or if the pressure in vehicle storage tank 16 is initially at a pressure greater than the inlet source pressure, vehicle storage tank 16 is preferably filled by simultaneously supplying CNG to tank 16 from compressor 14 and from intermediate storage tank 18 until such time as the pressure in vehicle storage tank 16 has equalized with the intermediate storage pressure. In this mode of operation, valves 22, 24, 26 and 30 are desirably open and valve 32 is closed, thereby permitting CNG to be supplied to vehicle storage tank 16 simultaneously from compressor 14 through lines 42, 38 and from intermediate storage tank 18 through lines 44, 42 and 38. CNG supplied to vehicle storage tank 16 from compressor 14 at this stage of refueling is compressed only to the prevailing vehicle storage tank pressure, and the rate of refueling is preferably accelerated by also supplying CNG to vehicle storage tank 16 from intermediate storage tank 18 at the intermediate storage pressure. The intermediate storage pressure when refueling begins is preferably within the range of from about 1700 to about 2700 psig, and most preferably within the range of from about 2300 to about 2400 psig, because the storage efficiencies for CNG at 70° F. are greatest within these pressure ranges. CNG supplied to vehicle storage tank 16 from intermediate storage tank 18 provides a maximum discharge volume per pound of pressure drop in the intermediate storage pressure because of the inherent efficiency in storing CNG at pressures between about 1700 and about 2700 psig at standard conditions. Less throughput and horsepower are required of compressor 14 than would otherwise be required to refill vehicle storage tank 16 because of the CNG being supplied from intermediate storage tank 18.

Once the pressure in vehicle storage tank 16 has equalized with the pressure in intermediate storage tank 18 at a pressure that is below the intended full tank pressure of the vehicle, valve 30 is closed and valve 32 is opened. CNG is then preferably supplied to compressor 14 from intermediate storage tank 18 through valve 32 at a suction pressure equal to the prevailing intermediate storage pressure, and compressor 14 continues to discharge CNG into vehicle storage tank 16 through valves 26, 24 and lines 42, 38 until the desired full vehicle tank pressure is reached. By supplying CNG to the suction side of compressor 14 at an intermediate storage pressure preferably ranging from about 1700 to about 2700 psig, and most preferably, from about 2300 to about 2400 psig, rather than at the inlet source pressure, the compressor discharge rate (CFM) is significantly increased without increasing the necessary horsepower.

The last step of the refueling method of the invention occurs when vehicle storage tank 16 is filled to the intended full tank pressure, and the compressor suction is switched back to the inlet source pressure by closing valve 32. At this time valves 24, 26 and 32 are closed and valves 22 and 30 are open. Compressor 14 desirably continues to operate until intermediate storage tank 18 is again returned to the preferred intermediate storage pressure in the range of from about 1700 to about 2700 psig, and most preferably, from about 2300 to about 2400 psig.

Figure 3:
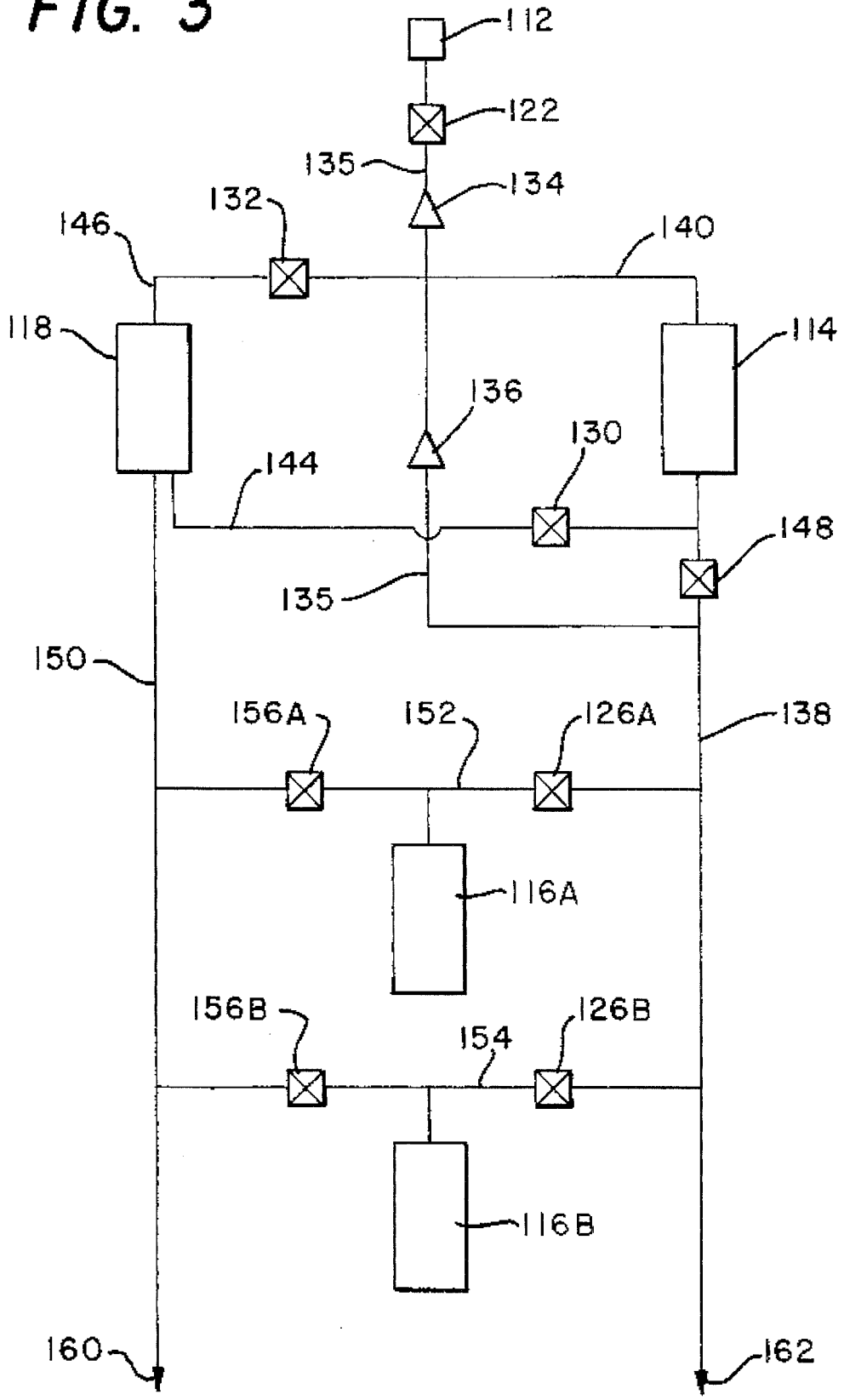
FIG. 3 is a simplified block flow diagram depicting an alternate embodiment of the CNG refueling system of the invention that is preferred for use in simultaneously refueling the CNG storage tanks of a plurality of vehicles.

Referring to FIG. 3, another embodiment of the refueling system of the invention is disclosed that comprises external natural gas source 112, compressor means 114, intermediate storage means 118, and a plurality of vehicle CNG storage means represented for illustrative purposes by vehicle storage tanks 1 1 6A, 116B. Natural gas is preferably supplied to compressor 114 through lines 135, 140, valve 122 and check valve 134. Natural gas from source 112 is also directed into compressor discharge line 138 through line 135 and check valve 136. Intermediate storage means 118, shown for illustrative purposes as a single tank, receives compressed natural gas discharged from compressor means 114 through line 144 and valve 130. CNG can likewise be selectively supplied to compressor means 114 from intermediate storage means 118 through line 146, valve 132, and line 140 for further compression. Vehicle CNG storage tanks 116A, 116B can be selectively filled with natural gas at the supply pressure through lines 135, 138, headers 152, 154, and valves 126A, 126B; with CNG from intermediate storage means 118 through fill line 150, headers 152, 154 and valves 156A, 156B; or with CNG discharged from compressor means 114 through compressor discharge line 138, headers 152, 154, and valves 148, 126A, 126B. According to a particularly preferred embodiment of the invention, vehicle storage tanks 116A, 116B can be filled simultaneously from intermediate storage means 118 and from compressor means 114 by opening valves 156A, 156B, 126A, 126B and 148 until such time as the vehicle storage tank pressure equalizes with the intermediate storage pressure, when valves 156A, 156B are closed and filling continues through compressor discharge line 138. With the system depicted in FIG. 3, it is also possible to fill vehicle storage tanks 116A, 116B either simultaneously or serially by selectively controlling the operation of valves 156A, 156B and 126A, 126B.

Arrows 160, 162 are shown at the lower ends of fill line 150 and compressor discharge line 138 to indicated that additional vehicle storage tanks can be connected to fill line 150 and discharge line 138 in like manner if desired. It is of course understood that the capacity of compressor means 114 will be divided by the number of positions simultaneously taking gas from compressor discharge line 138. Another limitation in the permissible number of headers 152, 154 or dispensing hoses is that fill line 150 and compressor discharge line 138 must be sufficiently large to accommodate flow to the total number of dispensing positions that are to be used simultaneously. With appropriate control systems, vehicle storage tanks 116A, 116B can have different initial pressures and temperatures, and can be connected or disconnected to headers 152, 154 at different times. When controlled, for example, by a computer, this system can be used to maximize the efficiency of refueling CNG storage tanks in multiple vehicles without requiring that any vehicle have to wait for any other. Except as otherwise noted herein, the system of FIG. 3 desirably functions like the system previously described in relation to FIG. 1.

With the vehicle refueling system and method disclosed herein, it is not necessary to complete vehicle storage tank refueling by compressing natural gas from the inlet source pressure to the maximum intended vehicle fill pressure; nor is it necessary to compress natural gas to intermediate storage pressures as high as the maximum intended vehicle fill pressure.

The preferred pressures stated herein are based upon the compressibility of natural gas at about 70° F., and it will be appreciated by those of ordinary skill in the art that such pressures can vary if the ambient temperatures are substantially above or below standard conditions. It will similarly be appreciated that in describing the system and method of the invention as disclosed herein, intervening pressure drops through flow lines, valves, gauges, and the like are not addressed, but will generally be relatively insignificant due to the short line lengths within the system. Also, while the system and method of the invention are disclosed herein in relation to a preferred embodiment for compressing natural gas and for refueling vehicle storage tanks with natural gas, it will be appreciated that the subject system and method are similarly applicable to other gasses and uses.

Other alterations and modifications of the invention will likewise become apparent to those of ordinary skill in the art upon reading the present disclosure, and it is intended that the scope of the invention disclosed herein be limited only by the broadest interpretation of the appended claims to which the inventor is legally entitled.

We claim:

1. A CNG refueling system for a plurality of motor vehicles each having CNG storage means is provided, the system comprising:

compressor means operable over suction pressures ranging from about 330 to about 3600 psig and discharge pressures ranging from about 330 psig to about 4500 psig;

at least one intermediate storage tank for storing CNG at pressures ranging from about 330 to about 3600 psig;

means for selectively delivering natural gas received from an external source to the compressor means;

means for selectively delivering CNG discharged from the compressor means into the intermediate storage tank until the pressure in the intermediate storage tank reaches a predetermined maximum level not greater than about 3600 psig;

means for selectively controlling the delivery of CNG to the CNG storage means of each vehicle;

means for selectively delivering CNG to each selected vehicle CNG storage means from the intermediate storage tank or from the compressor means;

and means for selectively supplying CNG to the compressor means from the intermediate storage tank until the pressure in each selected vehicle CNG storage means reaches a maximum intended vehicle storage fill pressure.

2. The system of claim 1, comprising means for selectively and simultaneously delivering CNG to each selected vehicle storage means from the intermediate storage tank and from the compressor means.

3. The system of claim 1, comprising means for selectively delivering natural gas received from the external source to the selected vehicle storage means until pressure in the selected vehicle storage means equalizes with the pressure of the external source.

4. The system of claim 1 wherein the compressor means comprises a hydraulic compressor.

5. The system of claim 1 wherein the compressor means has a compression ratio of up to about 10:1.

6. The system of claim 5 wherein the compressor means has a compression ratio of at least about 8:1.

7. A method for selectively refilling a plurality of vehicle CNG storage means from an initial pressure to an intended fill pressure with compressed natural gas, the method comprising the steps of:

providing a source of natural gas at a supply pressure ranging from about 330 to about 1000 psig;

providing an intermediate storage tank;

selectively delivering natural gas from the source to a compressor means that is operable at suction pressures ranging from about 330 to about 3600 psig with attendant discharge pressures ranging up to about 4500 psig;

compressing the natural gas and selectively storing the compressed natural gas discharged from the compressor means in the intermediate storage tank until an intermediate storage pressure ranging up to about 3600 psig is reached;

selectively delivering compressed natural gas to each selected vehicle CNG storage means from the intermediate storage tank or from the compressor means until the selected vehicle CNG storage means pressure equalizes with the intermediate storage tank pressure;

selectively delivering compressed natural gas to the compressor means from the intermediate storage tank and further compressing the natural gas;

and selectively delivering the further compressed natural gas from the compressor means to the selected vehicle CNG storage means until the selected vehicle CNG storage pressure reaches the intended fill pressure.

8. The method of claim 7 wherein compressed natural gas is simultaneously delivered to each selected vehicle CNG storage means from both the intermediate storage tank and from the compressor means until the vehicle CNG storage means pressure equalizes with the intermediate storage tank pressure.

9. The method of claim 7 wherein natural gas is selectively delivered from the source to the vehicle CNG storage means until the vehicle CNG storage means pressure equalizes with the supply pressure.

10. The method of claim 7 wherein the compressed natural gas is stored in the intermediate storage tank at a pressure ranging from about 1700 to about 2700 psig.

11. The method of claim 10 wherein the compressed natural gas is stored in the intermediate storage tank at a pressure ranging from about 2300 to about 2400 psig.

12. The method of claim 7 wherein the intended fill pressure ranges from about 3000 to about 4500 psig.

13. The method of claim 12 wherein the intended fill pressure ranges from about 3000 to about 3600 psig.

14. The method of claim 7 comprising the additional step of refilling the intermediate storage tank with compressed natural gas to an intermediate storage pressure ranging up to about 3600 psig.

15. The method of claim 14 wherein the intermediate storage tank is refilled to an intermediate storage pressure of from about 1700 to about 2700 psig.

16. The method of claim 15 wherein the intermediate storage tank is refilled to an intermediate storage pressure of from about 2300 to about 2400 psig..

* * * * *